United States Patent [19]

Mayfield et al.

[11] 4,047,391

[45] Sept. 13, 1977

[54] GROUT SEAL

[75] Inventors: Windel O. Mayfield; Clarence T. Thomerson; Tom C. Waldrop, all of Corsicana, Tex.

[73] Assignee: Regal Tool & Rubber Co., Inc., Corsicana, Tex.

[21] Appl. No.: 699,321

[22] Filed: June 24, 1976

[51] Int. Cl.[2] ..... E02D 5/14; E02D 5/52

[52] U.S. Cl. ..... 61/94; 61/89; 61/98; 61/100

[58] Field of Search ..... 61/87, 88, 89, 94, 102, 61/100, 53.5, 98, 99, 86; 166/116, 187; 277/237

[56] References Cited

U.S. PATENT DOCUMENTS 3,533,241 10/1970 Bowerman et al. ..... 61/53.5 X 3,570,259 3/1971 Thaxton ..... 61/94 X 3,844,002 10/1974 Slemmons ..... 61/91

*Primary Examiner*—Jacob Shapiro

*Attorney, Agent, or Firm*—Richards, Harris & Medlock

[57] ABSTRACT

A grout seal for a piling driven through a cylindrical platform leg into submerged strata includes an array of spring members having upper and lower end portions of cylindrical configuration, the lower and upper extremities of the portions, respectively, defining boundaries of inward diversion to form the central portion of the array. A reinforced elastomeric outer cover is provided for the central portion of the array. The array also includes an elastomeric pad mounted within the array and having a cylindrical inner face for contact with the pilings and an outer face conforming with the central portion of the array.

17 Claims, 6 Drawing Figures

GROUT SEAL

FIELD OF THE INVENTION

This invention relates to a grout seal for offshore platforms as used in oil well drilling and production, and more particularly relates to a structure of greatly improved reliability.

BACKGROUND OF THE INVENTION

Conventionally, an offshore drilling platform is fabricated in a harbor or an on shore location and then towed to a marine site where it is tipped on end and lowered so that the legs of the platform rest on the ocean floor. Traditionally, these legs are hollow structures so that pillings can be driven downwardly through the legs and into subterranean formations below the ocean floor. In the installation of such systems, it is desirable to fill an annulus between the piling and the platform legs as may exist so that the system is a rigid unitary structure when completely installed. Further, it is desirable that the grout that is to be placed in such annulus be maintained free from contamination and debris as might be otherwise present if measures were not taken to prevent the influx of such materials in the course of installation of the system. Heretofore, grout seals have proven to be unreliable in sealing the annulus between the piling and platform legs.

SUMMARY OF THE INVENTION

In accordance with the present invention, a grout seal for a pilling driven through a cylindrical platform leg into a submerged strata includes an array of spring members having upper and lower end portions of cylindrical configuration. The lower and upper extremities of the upper and lower portions, respectively, define boundaries of inward diversion to form the central portion of the array. The seal includes a reinforced elastomeric outer cover for the central portion of the array and an elastomeric pad mounted inside the array. The elastomeric pad has a cylindrical inner face for contact with the piling and an outer face conforming with the central portion of the array.

DESCRIPTION OF THE DRAWINGS

The novel features believed characteristic of the invention are set forth in the appended claims. The invention itself, however, as well as further objects and advantages thereof, will best be understood by reference to the following detailed description of an illustrative embodiment taken in conjunction with the accompanying drawings, in which:

DESCRIPTION OF THE PREFERRED EMBODIMENT

Figure 1:
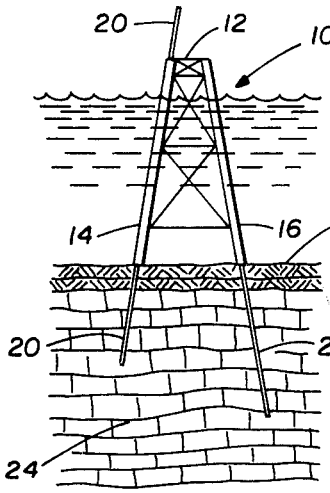
FIG. 1 is an illustration of an offshore installation where pilings are driven through pipe forming portions of an offshore platform structure to anchor the structure.

Referring now to FIG. 1, an offshore platform generally referred to as 10 has been illustrated. Conventionally, a structure 12 having a plurality of depending legs, such as the legs 14 and 16, is fabricated in a harbor or an on shore location and then towed to a marine site where it is tipped on end and lowered so that the ends of legs 14 and 16 rest on the ocean floor 18. Legs 14 and 16 traditionally are hollow structures so that pilings 20 and 22 can be driven downwardly through legs 14 and 16, respectively, and into the subterranean formation 24. In the illustration shown, piling 22 is driven to its total depth whereas piling 20 is still partially exposed above the deck of the offshore platform 10.

Figure 2:
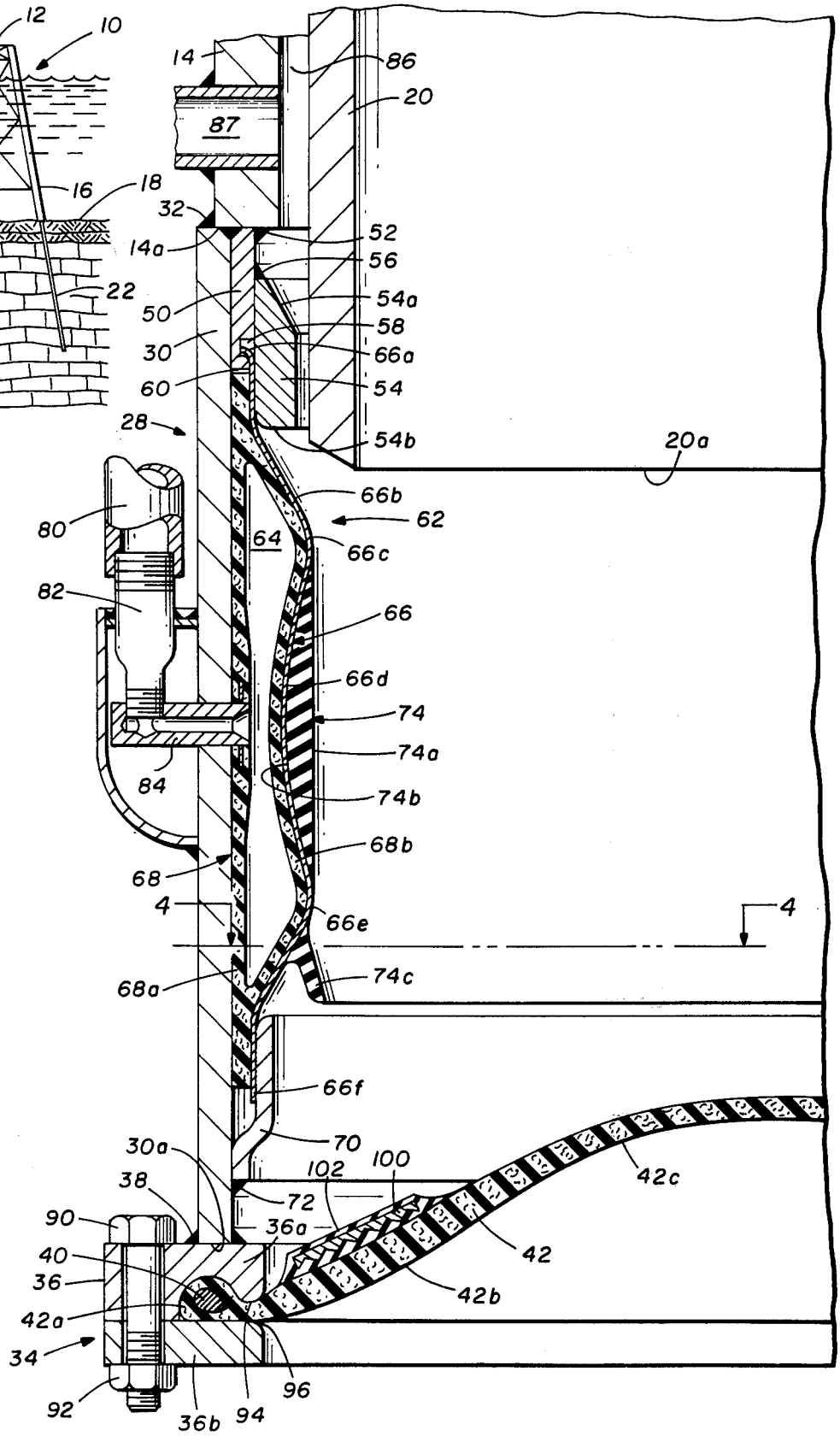
FIG. 2 is a sectional view of the lower portion of a leg of the platform showing a preferred seal in accordance with the present invention.
Figure 3:
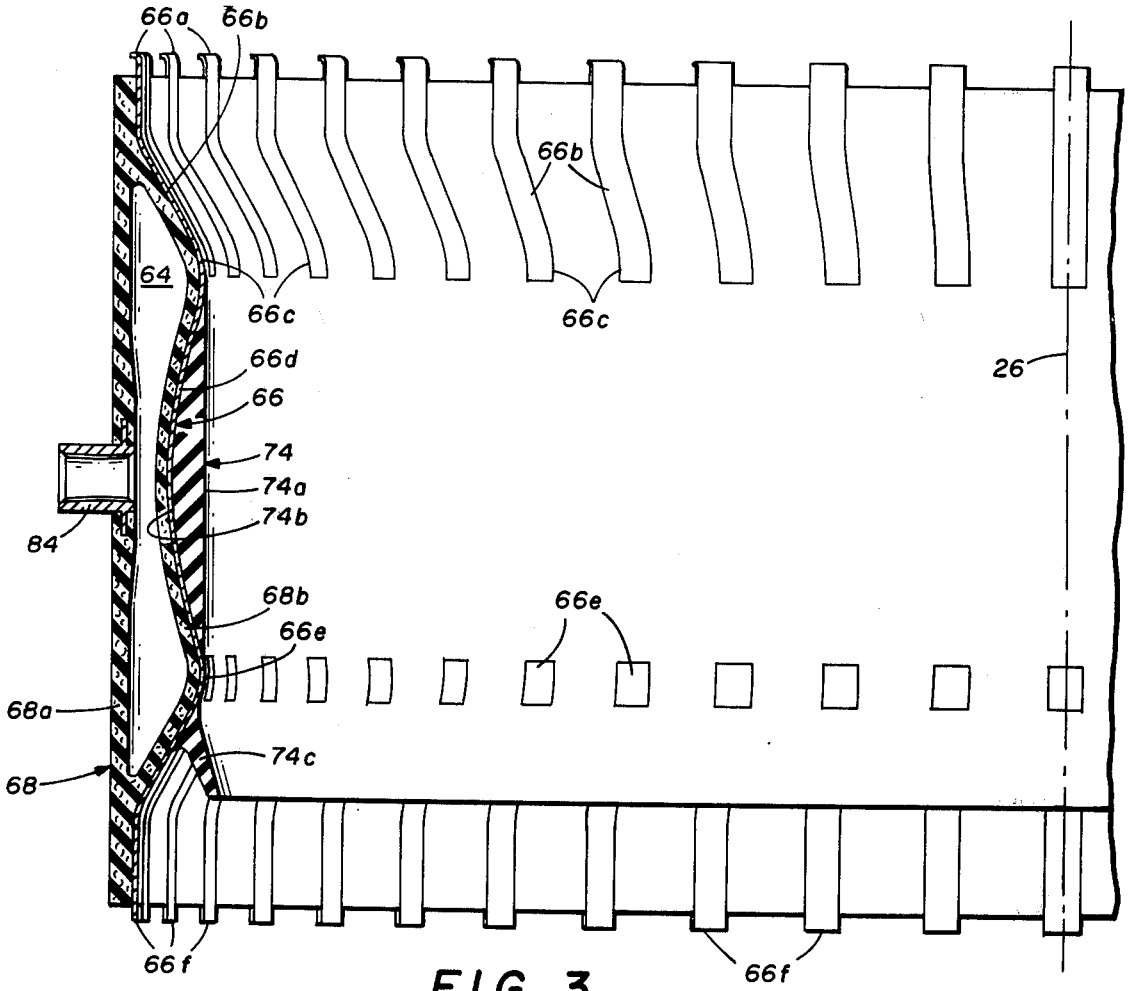
FIG. 3 is a sectional view partially in plan showing the seal of FIG. 2.

A preferred embodiment of the invention is illustrated in FIG. 2, in which the structure comprising the lower end of leg 14 through which piling 20 extends has been illustrated in connection with a grout seal structure embodying the present invention. FIG. 2 comprises a sectional view of the lower end of the leg 14 and the piling 20, it being understood that the system is symmetrical about center axis 26 (FIG. 3). As illustrated, the lower end 20*a* of piling 20 is poised above the sealing structure generally referred to as 28 and is in position to be driven downward below the lower end of sealing structure 28 and into the formations therebelow.

Figure 4:
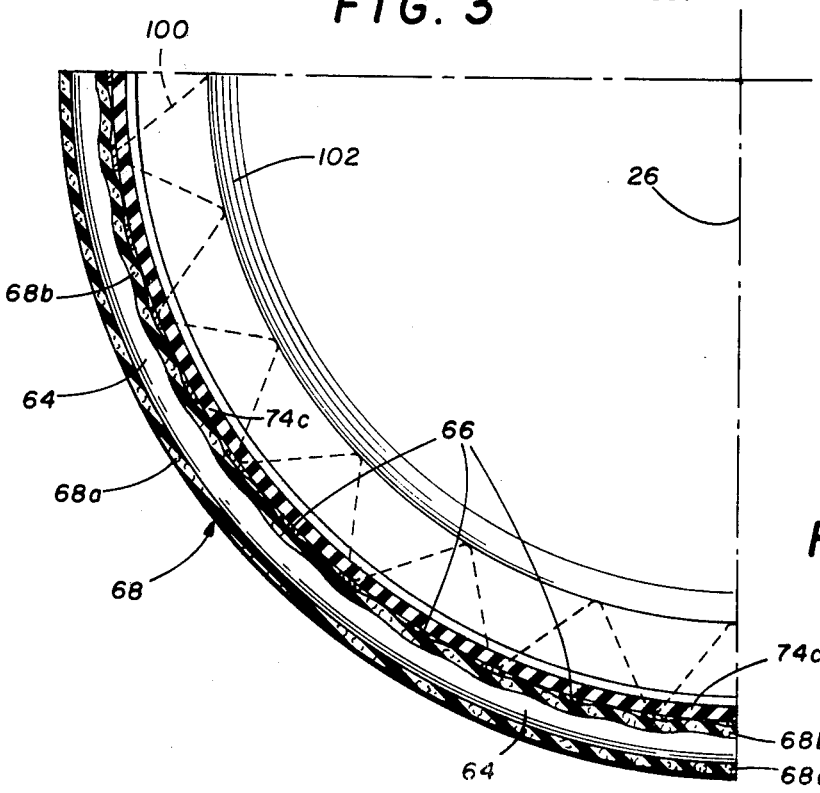
FIG. 4 is a sectional view taken along line 4—4 of FIG. 2.

Referring simultaneously to FIGS. 2, 3 and 4, sealing structure 28 is mounted on the lower end of leg or platform jacket 14 and is designed to permit therethrough of piling 20 and to eatablish a fluid tight seal with the inner wall of leg 14. Leg 14 includes a cylindrical extension 30 which is welded as at 32 to the lower end 14*a* of leg 14. Cylindrical extension 30 is slightly larger in diameter than leg 14 and has a closure structure generally referred to as 34 which includes a foot clamp 36 welded as at 38 to the lower end 30*a*. Foot clamp 36 comprises a fixed ring 36*a* and a removable ring 36*b*. An annular groove is formed in the lower face of ring 36*a* to receive a ring 40 of a closure diaphragm 42 to be subsequently described.

A cylindrical extension 50 is welded as at 52 to the bottom 14*a* of leg 14 and has an outside diameter corresponding to the inside diameter of cylindrical extension 30. A guide ring 54 is welded at 56 to the inner surface of cylinder 50 and has an upper beveled surface 54*a* and a lower outer curved perimeter 54*b*. The lower portion of cylinder 50 is provided with an annular groove 58 and a series of short axially extending slots 60. Slots 60 are spaced on the order to two inches apart around the entire perimeter of cylinder 50.

The grout seal 62 comprises a packer which is inflatable to vary the dimensions of an interior annular cavity 64. Grout seal 62 includes an array of flat springs, such as the spring 66, having an upper end 66*a*. Upper end 66*a* of spring 66 is positioned and received by groove 58.

Spring 66 is molded into a flat cloth reinforced sealing member 68. It will be noted that spring 66 deviates in section 66*b* inwardly away from the wall of cylindrical extension 30 to a crest 66*c* and then deviates back out toward cylindrical extension 30 in the center section 66*d* and again inwardly to crest 66*e* and finally outwardly and downwardly to the end 66*f*. End 66*f* of spring 66 comprises a straight section which is nested between a retaining ring 70 and the lower margin of 68*a*. Retaining ring 70 is secured by weld 72 to the inner surface of cylindrical extension 30 near lower end 30*a* thereof and immediately above foot clamp 36.

Sealing member 68 is provided with a continuous annular wall structure including an outer cylindrical body section 68*a* and an inner body section 68*b* that has contours substantially conforming to the contour of the spring 66. A filler section 74 is composed of a resilient material such as rubber or the like and is molded to sealing member 68. Filler section 74 has a cylindrical inner wall 74*a* and a curved outer wall 74*b* that conforms with the inner surface of spring 66. An initial sealing lip 74*c* is molded to the wall section 74*a* immediately below crown 66*e* of spring 66 and extends downwardly and inwardly therefrom.

A fluid pressure line 80 extending from the surface of offshore platform 10 downwardly along the outer wall of leg 14 is connected by way of a nipple 82 into a subpipe 84. Subpipe 84 leads through the wall of cylindrical extension 30 and is molded integrally with portion 68*a* of sealing member 68 so that fluid pressure may be introduced into annular cavity 64 to expand the same into contact with the outer surface of the piling 20 when piling 20 is extended downwardly through seal 28. Filler section 74 is formed of a homogeneous structure of relatively soft rubber and is without the reinforcement which characterizes the multi layer of fabrics in sealing member 68.

Spring 66 serves the purpose of distributing the load over a relatively long contact area on piling 20 when pressure is applied to the annular cavity 64. Spring 66 serves to enhance the length of the contact area whereas sealing lip 74*c* serves to arrest the flow into the leg 10 of water and debris when the diaphragm 42 is ruptured by passage therethrough of piling 20. In practice, piling 20 is driven through the unit to a desired depth after which grout seal 62 is actuated by application of pressure through line 80 to effect a seal between the outer wall of piling 20 and the filler section 74*a*.

After the piling 20 has been driven to the desired depth, a cement grout is pumped into the annulus 86 so that platform leg 14 and piling 20 are rigidly adhered and form a unitary structure.

It will be recognized that the zone outside the diaphragm 42 is subject to hydrostatic pressures the magnitude of which depends upon the depth of the water at the location being worked. Thus, when grout is pumped into annulus 86 through grout line 87, it is desired that the seal to the outer surface of piling 20 be maintained without interruption. Spring 66 serves to oppose any forces that would tend to extrude the annular cavity 64 in either direction and thus give annular cavity 64 axial integrity. The lower end 66*f* of spring 66 is slidable behind the retaining ring 70 to accommodate some movement. Upper end 66*a* of spring 66 is nested in groove 58 so that the upper end of annular cavity 64 is fixed whereas the lower end may vary against some relative movement.

As previously stated, lower end of leg 14 is closed by a closure diaphragm 42 which is composed of a reinforced elastomeric material such as rubber or the like. Referring to FIGS. 2 and 4, closure diaphragm 42 includes ring 40 having a teardrop shaped cross section. Ring 40 is molded to diaphragm 42 and is retained between the confronting faces of rings 36*a* and 36*b*. The periphery 42*a* of closure diaphragm 42 is therefore squeezed between rings 36*a* and 36*b* which are connected by bolt 90 and nut 92. In order to prevent damaging of closure diaphragm 42 upon flexing thereof, it is desirable to chamfer the internal inner edges 94 and 96 of rings 36*a* and 36*b*, respectively.

Closure diaphragm 42 includes a plurality of knife blades such as rule cutter 100, located near the outer periphery of diaphragm 42 at 42*b*. Rule cutter 100 is enclosed by a filler 102 such as rubber or the like, which is molded to the upper surface of closure diaphragm 42 in the area of 42*b*. Closure diaphragm 42 has a variable thickness, being relatively thicker in the area of 42*b* below cutter 100 than in the central portion 42*c*. The variable thickness permits use of less material in the manufacture of closure diaphragm 42 which is characterized by a multi layer fabric reinforced rubber.

In operation, as piling 20 is driven down through leg 14, the lower end 20*a* of piling 20 will engage filler 102 and thrust the rule cutter 100 downwardly through portion 42*b* of closure diaphragm 42. This downward motion will then sever diaphragm 42 and permit piling 20 to proceed through the bottom end of leg 14 into the subterranean formation 24 (FIG. 1).

Figure 5:
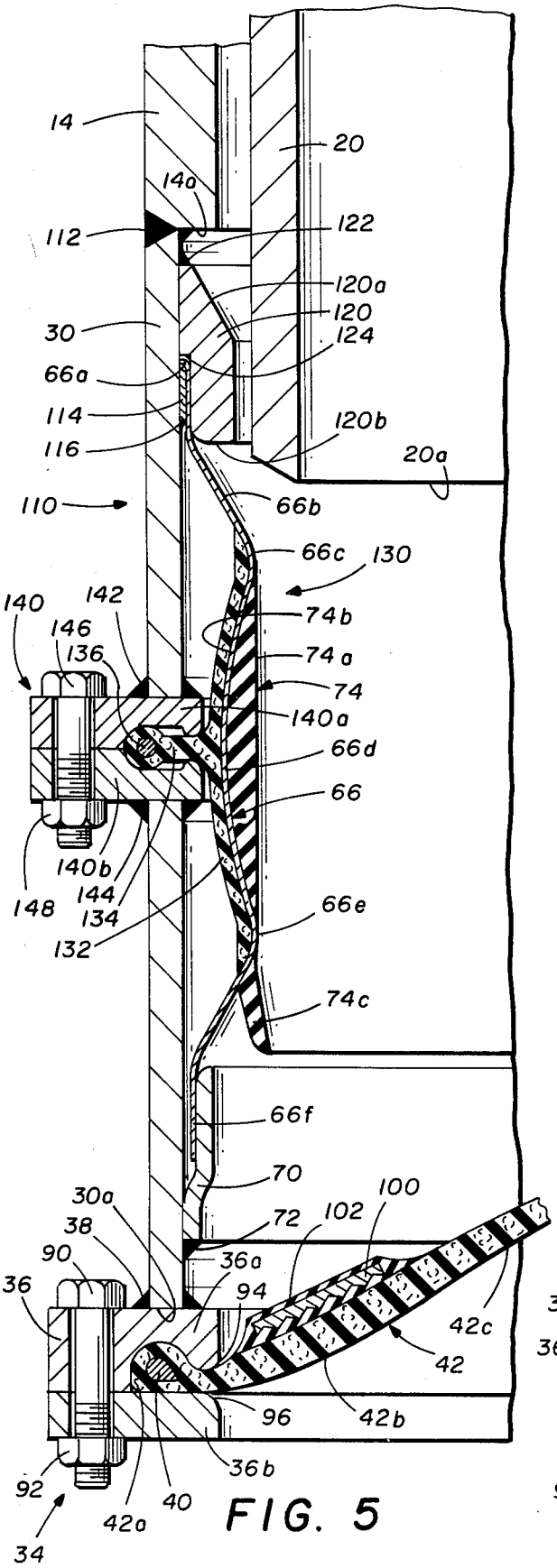
FIG. 5 is an embodiment of the invention where the sealing member is center anchored.

Referring now to FIG. 5, a second embodiment of the grout seal is shown wherein like numerals are used for like and corresponding elements. A sealing structure 110 is mounted on the lower end of leg 14 and is designed to permit passage therethrough of piling 20 and to establish a fluid tight seal with the inner wall of leg 14. Leg 14 includes a cylindrical extension 30 which is welded as at 112 to the lower end 14*a* of leg 14. Cylindrical extension 30 has a diameter corresponding to the diameter of leg 14 and includes a closure structure generally referred to as 34 which has previously been described in connection with FIG. 2.

A cylindrical ring 14 is welded as at 116 to the interior surface of leg 14. A guide ring 120 is welded at 122 to the inner surface of leg 14 and positioned to form an annular groove 124 between guide ring 120 and cylindrical ring 114. Guide ring 120 has an upper beveled surface 120*a* and a lower outer curve perimeter 120*b*.

The grout seal 130 comprises a packer which includes an array of flat springs, such as spring 66, having an upper end 66*a*. Upper end 66*a* of spring 66 is positioned and received by groove 124. Spring 66 is molded into a flat cloth reinforced sealing member 132. It will be noted that spring 66 deviates in section 66*b* inwardly away from the wall of cylindrical extension 30 to a crest 66*c* and the deviates back towards cylindrical extension 30 in the central section 66*d* and again inwardly to crest 66*e* and finally outwardly and downwardly to the end 66*f*. End 66*f* of spring 66 comprises a straight section which is nested between a retaining ring 70 and cylindrical extension 30. Retaining ring 70 is secured by weld 72 to the inner surface of cylindrical extension 30 near the lower end 30*a* thereof and immediately above the foot clamp 36.

Sealing member 132 is provided with an annular extension 134 which is molded integrally with sealing member 132. The peripheral section of annular extension 134 includes an annular reinforcing ring 136. Ring 136 has a circular cross sectional shape.

Sealing member 132 is mounted to cylindrical extension 30 through the use of a clamp assembly 140. Clamp assembly 140 includes an upper fixed ring 140*a* welded as at 142 to cylindrical extension 30 and a lower fixed ring 140*b* welded as at 144 to cylindrical extension 30. An annular groove of substantially rectangular cross sectional shape is formed in the confronting faces of rings 140*a* and 140*b* to receive ring 136 and the annular extension 134 of sealing member 132. The peripheral portion of annular extension 134 is therefore squeezed between rings 140a and 140b which are connected by bolt 146 and nut 148.

A filler section 74 is composed of a resilient material such as rubber or the like and is molded to sealing member 132. Filler section 74 has a cylindrical inner wall 74a and a curved outer wall 74b that conforms with the inner surface of spring 66. An initial sealing lip 74c is molded to the wall section 74a immediately below crown 66e of spring 66 and extends downwardly and inwardly therefrom.

Figure 6:
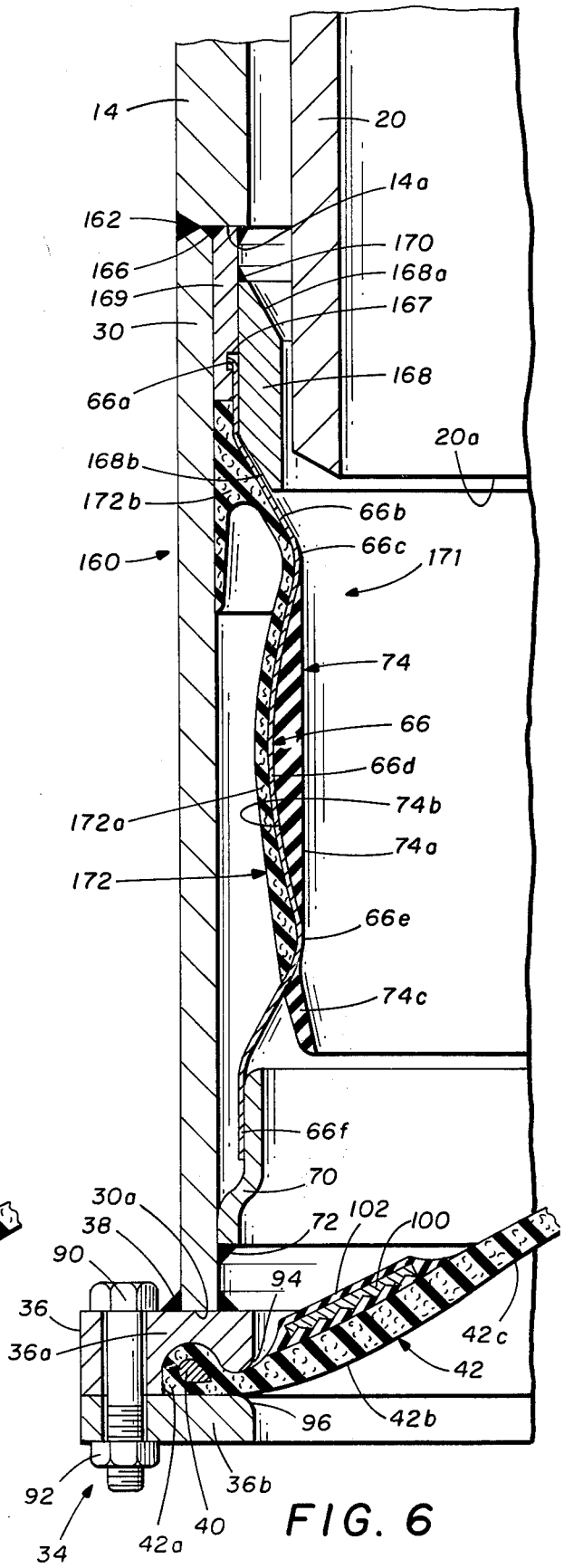
FIG. 6 is a further embodiment of a free type seal anchored at the upper end.

Referring now to FIG. 6, a third embodiment of the grout seal is shown wherein like numerals are used for like and corresponding elements. A sealing structure 160 is mounted on the lower end of leg 14, which includes cylindrical extension 30 welded as at 162 to the lower end 14a of leg 14. Cylindrical extension 30 also has a closure structure generally referred to as 34 which has previously been described.

A cylindrical extension 169 is welded as at 166 to the bottom 14a of leg 14 and has an outside diameter corresponding to the inside diameter of cylindrical extension 30. The lower portion of cylindrical extension 169 is provided with an annular groove 167. A guide ring 168 is welded at 170 to the inner surface of cylindrical extension 169 and has an upper beveled surface 168a and a lower outer curved perimeter 168b. Upper end 66a of spring 66 is positioned and received by annular groove 167.

Spring 66 has a similar configuration as the spring previously described in connection with FIGS. 2 and 5. The lower end 66f of spring 66 is nested between retaining ring 70 and cylindrical extension 30.

The grout seal 171 includes a sealing member 172. Sealing member 172 is provided with an inner body section 172a that has a contour substantially conforming to the contour of spring 66 and an outer cylindrical body section 172b which conforms to the inner surface of cylindrical extension 30.

Having described the invention in connection with certain specific embodiments thereof, it is to be understood that further modifications may now suggest themselves to those skilled in the art and it is intended to cover such modifications as fall within the scope of the appended claims.

What is claimed is:

1. A grout seal for a piling driven through a cylindrical platform leg into submerged strata which comprises:

a. an array of spring members having upper and lower end portions of cylindrical configuration, the lower and upper extremities of said portions, respectively, defining boundaries of inward diversion to form a central outwardly bowed portion of said array, b. a reinforced elastomeric outer cover for said central portion of said array, and c. an elastomeric pad mounted inside said array having a cylindrical inner face for contact with said piling and an outer face conforming with said central outwardly bowed portion of said array.

2. The grout seal of claim 1 and further including:

a. an upper and lower reinforced elastomeric outer cover for said upper and lower extremities of said array and being continuous with said outer cover for said central portion of said array, and b. said upper and lower outer covers being integrally joined by a central reinforced elastomeric member having a cylindrical outer face for contact with the inner surface of said leg, thereby forming an annular cavity between said central member of reinforced elastomeric material and said outer cover.

3. The grout seal of claim 1 wherein said outer cover further includes:

a. a reinforced elastomeric annular ring molded integrally and centrally to said outer cover, b. an annular reinforcing element molded in the periphery of said annular ring, and c. means for securing said elastomeric annular ring to said leg.

4. The grout seal of claim 3 wherein said means for securing said elastomeric annular ring to said leg comprises:

a. upper and lower complementary annular mounting rings, b. means for fastening together said annular mounting rings, c. said mounting rings having an annular groove of rectangular cross sectional shape, d. said annular groove being of slightly less radial diameter than said elastomeric annular ring for retaining and squeezing said periphery when said mounting rings are secured in an abutting relationship, and e. means for securing said mounting ring to the lower portion of said leg.

5. The grout seal of claim 1 and further including an upper reinforced elstomeric outer cover for said upper extremity of said array being integral with said outer cover for said central portion and contacting the inner surface of said leg.

6. The grout seal of claim 1 wherein said elastomeric pad further includes a lower extension member for sealing the annulus between said leg and said piling when said piling is passed through the seal.

7. A grout seal for a piling driven through a cylindrical platform leg into submerged strata which comprises:

a. a cylindrical array of springs inwardly diverted from upper and lower end portions and centrally bowed outwardly, b. a reinforced elastomeric outer cover for the outer surface of said springs having upper and lower ends and extending from said upper end of said springs to said lower end of said springs, c. said upper and lower outer cover ends being integrally connected by a central reinforced elastomeric member having a cylindrical outer face for contact with the inner surface of said leg, thereby forming an annular cavity between said central member and said outer cover, d. an elastomeric pad having a cylindrical inner face for contact with said piling and an outer face conforming with said centrally bowed portion of said array and integral with said outer cover, e. means for captivating said ends of said springs, and f. means extending from said lower end portions of said array for contacting said piling to provide a lip seal between said piling and said array.

8. The grout seal of claim 7 and further including means for pressurizing said annular cavity.

9. The grout seal of claim 7 wherein said means for captivating said upper end of said springs includes:

a. a first cylindrical ring including an annular groove and being fixed to the inner surface of said leg, b. a second cylindrical ring being fixed to the lower end of said first cylindrical ring, and c. said upper end of said springs being retained in said annular groove by said second cylindrical ring.

10. The grout seal of claim 7 wherein the means for captivating said lower ends of said springs includes a retaining ring fixed to said inner surface of said leg to permit slidable movement of said lower ends of said springs between said retaining ring and said inner surface of said leg.

11. A grout seal for a piling driven through a cylindrical platform leg into submerged strata which comprises:

a. a cylindrical array of springs inwardly diverted from upper and lower end portions and centrally bowed outwardly,
b. a reinforced elastomeric outer cover for said central portion of said array,
c. a reinforced elastomeric annular ring molded integrally and centrally to said outer cover,
d. an annular reinforcing element molded in the periphery of said annular ring,
e. means for securing said annular ring to said leg,
f. an elastomeric pad having a cylindrical inner face for contact with said piling and an outer face conforming with said centrally bowed portion of said array and integrated with said outer cover,
g. means for captivating said ends of said springs, and
h. means extending from said lower end portion of said array for contacting said piling to provide a lip seal between said piling and said leg.

12. The grout seal of claim 11 wherein said means for securing said elastomeric annular ring comprises:

a. upper and lower complementary annular mounting rings,
b. means for fastening together said annular mounting rings,
c. said mounting rings having an annular groove of rectangular cross sectional shape,
d. said annular groove being of slightly less radial diameter than said elastomeric annular ring for retaining and squeezing said periphery when said mounting rings are secured in an abutting relationship, and
e. means for securing said mounting rings to the lower portion of said leg.

13. The grout seal of claim 11 wherein said means for captivating said upper end of said springs includes:

a. a first cylindrical ring being fixed to the inner surface of said leg,
b. a second cylindrical ring being fixed to the inner surface of said leg, and
c. said upper end of said springs being retained in said annular groove formed between said first and second cylindrical rings.

14. The grout seal of claim 11 wherein said means for captivating said lower end of said springs include a retaining ring fixed to said inner surface of said leg to permit slidable movement of said lower end between said retaining ring and said inner surface of said leg.

15. A grout seal for a piling driven through a cylindrical platform leg into submerged strata which comprises:

a. a cylindrical array of springs inwardly diverted from upper and lower end portions and centrally bowed outwardly,
b. a reinforced elastomeric outer cover for said central portion of said array,
c. an upper reinforced elastomeric outer cover for said upper end portion of said array being integral with said outer cover for said central portion and contacting the inner surface of said leg,
d. an elastomeric pad having a cylindrical inner face for contact with said piling and an outer face conforming with said centrally bowed portion of said array and integrated with said outer cover,
e. means for captivating said ends of said springs, and
f. means extending from said lower end of said array for contacting said piling to provide a lip seal between said piling said said leg.

16. A grout seal for a piling driven through a cylindrical platform leg into submerged strata which comprises:

a. a cylindrical array of springs inwardly diverted from upper and lower end portions and centrally bowed outwardly,
b. a reinforced elastomeric outer cover for said central portion of said array,
c. an upper reinforced elastomeric outer cover for said upper end portion of said array being integral with said outer cover for said central portion and contacting the inner surface of said leg,
d. an elastomeric pad having a cylindrical inner face for contact with said piling and an outer face conforming with said centrally bowed portion of said array and integrated with said outer cover,
e. means for captivating said ends of said springs, including
   i. a first cylindrical ring including an annular groove and being fixed to the inner surface of said leg,
   ii. a second cylindrical ring being fixed to the lower end of said first cylindrical ring, and
   iii. said upper end of said springs being retained in said annular groove by said second cylindrical ring, and
f. means extending from said lower end of said array for contacting said piling to provide a lip seal between said piling and said leg.

17. The grout seal of claim 15 wherein said means for captivating said lower end of said spring includes a retaining ring fixed to said inner surface of said leg to permit slidable movement of said lower end of said springs between said retaining ring and said inner surface of said leg.

* * * * *